United States Patent [19]

Meijer et al.

[11] 4,034,804

[45] July 12, 1977

[54] MOTOR-CAR RADIATOR

[75] Inventors: Roelf Jan Meijer; Jan Mulder, both of Eindhoven, Netherlands

[73] Assignee: U.S. Philips Corporation, New York, N.Y.

[21] Appl. No.: 596,020

[22] Filed: July 16, 1975

Related U.S. Application Data

[63] Continuation of Ser. No. 379,708, July 16, 1973, abandoned, which is a continuation of Ser. No. 203,609, Dec. 1, 1971, abandoned.

[30] Foreign Application Priority Data

Sept. 23, 1971 Netherlands ..... 7113051

[51] Int. Cl.[2] ..... F28D 1/04

[52] U.S. Cl. ..... 165/148; 165/149; 165/151

[58] Field of Search ..... 244/57; 123/41.48, 41.49, 123/41.51; 165/148, 149, 151, 122, 124, 126

[56] References Cited

U.S. PATENT DOCUMENTS

| | | | |
|---|---|---|---|
| 1,152,328 | 8/1915 | Loring | 165/151 |
| 1,227,770 | 5/1917 | Fleishmann | 165/149 |
| 1,528,461 | 3/1925 | Woolfe | 165/151 |

FOREIGN PATENT DOCUMENTS

| | | | |
|---|---|---|---|
| 788,080 | 7/1935 | France | 165/151 |
| 923,021 | 2/1947 | France | 165/151 |
| 241,234 | 11/1911 | Germany | 165/148 |
| 71,969 | 3/1916 | Switzerland | 165/148 |
| 231,749 | 4/1925 | United Kingdom | 165/151 |

*Primary Examiner*—Carroll B. Dority, Jr.
*Assistant Examiner*—Daniel J. O'Connor
*Attorney, Agent, or Firm*—Frank R. Trifari

[57] ABSTRACT

A radiator operable with a flow of air for cooling a quantity of water and formed as zig-zag walls, each of which comprises air ducts of predetermined ratio of flow length to hydraulic diameter.

9 Claims, 4 Drawing Figures

*INVENTORS*
ROELF JAN MEIJER
JAN MULDER
*BY*

MOTOR-CAR RADIATOR

This is a continuation of Ser. No. 379,708, filed July 16, 1973, which was a continuation of Ser. No. 203,609, filed Dec. 1, 1971, both now abandoned.

BACKGROUND OF THE INVENTION

The invention relates to a motor-car radiator which is particularly suitable for use in the cooling system of an external combustion engine, said radiator having a number of parallel cooling water pipes which communicate at one end with an inlet and at the other end with an outlet for cooling water. The pipes are connected by a number of metal components, for example strips or gauze, extending at right angles to said pipes and being in a head conducting contact therewith.

In combustion engines, only a part of the evolved thermal energy is converted into mechanical energy, while the other part has to be dissipated as heat due to energy losses. A part of said heat due to energy losses is dissipated together with the hot exhaust gases, while another considerable part is given off to the ambient air via the cooling system and the radiator present therein. This radiator usually is situated in the front of the car in which the engine is present as a traction means.

When, as has been usual up till now, an internal combustion engine is used as a traction means, the space in the front of the motor-car usually is sufficient cooling capacity without too may difficulties. If, however, an external combustion engine, for example the Stirling engine or the steam engine, is used as a source of propulsion, difficulties occur immediately in connection with the radiator. As a matter of fact, the amount of thermal energy in this type of engines which has to be dissipated to the atmosphere via the radiator is much larger than in internal combustion engines. This means that the cooling capacity of the radiator has to be increased.

A first possibility of achieving this is to use a conventional radiator having a larger front face area. However, it will soon become apparent in this case that the dimensions of the radiator become too large for the front of the motor-car. A second possibility could be an increase of the cooling capacity per surface unit by refining the construction of the radiator, so by using narrower flow ducts for the air, or by increasing the length of the ducts by using a thicker radiator. This meets with two objections. First of all, with an acceptable front face area, these measures result in a radiator having such a large resistance to flow that the fan which is then necessary requires an unacceptably large power to draw in the required amount of air. Secondly, the fine flow ducts for the air will soon give rise to pollution of the radiator by insects and so on.

A third possibility which has been considered in carrying the invention into effect is the arrangement in V-shape of a number of conventional radiator units. Such a shape of radiator is known from United Kingdom Pat. No. 506,146 for incorporation in the wing of an airplane. Since the thickness of the conventional radiators is from 5 to 10 cm it will be obvious that, in order to obtain herewith an increase of the radiator surface area without increasing the overall transverse dimension, a radiator will be obtained having very a large dimension in the longitudinal direction which is unacceptable in motor-cars and is furthermore unattractive because the occurring flow losses in the deep V-shape reduce the effect of the increase in surface area.

SUMMARY OF THE INVENTION

It is the object of the invention to provide, on the basis of the above considerations, a radiator which has a large cooling capacity, a low weight and occupies little space. The radiator according to the invention is characterized in that the cooling water pipes are arranged in a number of flat elements, the upper and lower sides of which are each located in a common plane and the two other sides are located in the front and rear plane, respectively, of the radiator. The elements enclose an angle of more than 45° with the front and rear plane of the radiator, the elements being connected together alternately on their front and rear sides in an air-tight manner so that a pleated front and rear side, respectively, is obtained. The dimension of the thickness of each of the elements is at most 25 mm, the quotient $L/d_h$ being smaller 15, L being the length and $d_h$ the hydraulic diameter of the air ducts in each of the element.

In this manner a radiator is obtained in which a very large cooling capacity is associated with acceptable width and thickness dimensions so that incorporation in motor-cars is possible without great problems. As a result of the fine subdivision, a large cooling capacity per unit of front face area is obtained in which nevertheless the resistance to flow is low, while, as a result of the inclined position of the radiator element relative to the flow direction of the air, surprisingly substantially no pollution occurs. Insects and other dirt gather neatly at the areas where the rear sides of the elements are connected together.

In order to ensure that contaminations are readily caught and the radiator can easily be cleaned, a further favourable embodiment is characterized in that each of the connections on the rear side of the elements is constructed as a channel-shaped connection member for receiving contaminations.

In a preferred embodiment according to the invention, the channel-shaped connection members communicate on their lower side with an exhaust channel which extends below the radiator and whose aperture faces the front side of the radiator. In this manner, contaminations gathered in the channels with fall down and be removed via the exhaust channel when the vehicle is stationary. In order to ensure a good guide of the air entering the radiator, each of the connections on the front side of the elements have a good aerodynamic shape so that the air readily flows into the radiator.

In a further favorable embodiment, each of the elements comprises on its outer circumference a layer of fine gauze having a mesh-width smaller than 1.5 mm. This prevents pollution of the radiator in a very effective manner while in addition said gauze is effectively involved in the heat exchange.

In order that the invention may be readily carried into effect, it will now be described in greater detail, by way of example, with reference to the accompanying drawing.

DESCRIPTION OF THE PREFERRED EMBODIMENTS

Figure 1:
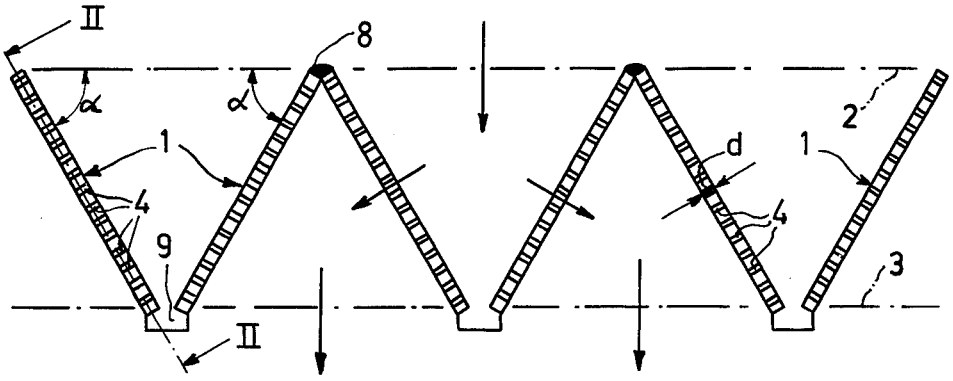
FIGS. 1 and 2 are two mutually perpendicular sectional views of a radiator consisting of a number of elements arranged in V-shape.
Figure 2:
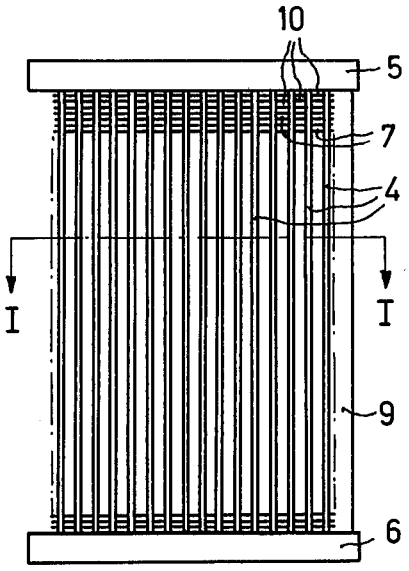

FIGS. 1 and 2 show two mutually perpendicular sectional views, which are diagrammatic and not drawn to scale, of a part of a radiator which is constructed from a number of elements 1 which enclose an angle $\alpha$ with the front and rear faces 2 and 3, respectively, of the radiator.

Each of the elements 1 comprises a number of cooling water pipes 4 which communicate at one end with a common inlet duct 5 and on the other end with a common outlet duct 6. The pipes 4 are connected together by a large number of flat metal strips 7 which are connected in a heat conducting relationship with the pipes, for example, by soldering.

The elements 1 are connected together by a channel-like part 9 on their rear side and at the area 8 and on their front side. When the radiator is accommodated in a motor-car, the air entering the radiator will flow through the radiator in the direction of the arrows. The connections at the area 8 have a good aerodynamic shape, so that the air entering the radiator can easily be guided to the radiator surfaces.

As a result of the arrangement in V-shape of the elements 1, the radiator surface area has been increased considerably, namely by a factor ($1/\cos.\alpha$). Of course the thickness of the elements should be subtracted therefrom, because at the areas 8 and 9 this provides a section through which no air can pass. In known radiators having a thickness from 5 to 10 cm, a large part of the effect of the V-shape is thus lost. In the radiator according to the invention the thickness $d$ of each of the elements is at most 25 mm. This means that the connections 8, 9 require only little space. In order to enable this small thickness of the elements, while maintaining a sufficient cooling capacity per surface unit, it furthermore holds for the ducts 10 through which the air flows (between cooling water pipes and metal strips 7) that the quotient $L/d_h < 15$. So when $L = 25$ mm, the hydraulic diameter of said ducts must be smaller than or equal to 1.6 mm, the hydraulic diameter being defined as 4 times the surface divided by the circumference of the cross-section of the relevant duct. This means consequently an extremely fine division of the radiator, in which the metal strips 7 are situated only at a very small distance from each other (smaller than or equal to 0.8 mm). It has been found that in this manner a radiator is obtained having a cooling capacity per surface unit which is many times larger than that of known radiators.

The surprising effect is that said radiator, in spite of its fine division, is not polluted during use. Contaminations in the air have been found to collect at the area 9. This is a result of the fact that, whereas the air is deflected, the contaminations go straight forward due to their larger inertia and land in the channel 9. In order to even better check pollution, a layer of a fine gauze having a maximum mesh width of 1.5 mm may be provided on the outside of the elements, if desirable, which gauze simultaneously serves as a heat transmitting surface since it is in a good heat conducting contact with the metal strips. Alternatively, instead of the strips 7 it is possible to provide only a number of layers of gauze on the cooling water pipes. In addition, all possible combinations of strips and gauze may be used.

Although the channel 9 has certain advantages, for example as far as cleaning is concerned, it may be omitted in certain circumstances in which case the elements at that area are in direct contact with each other. The dirt will then accumulate of course in the corner formed, but if this is taken into account in calculating the radiator, this need not be a drawback.

Figure 3:
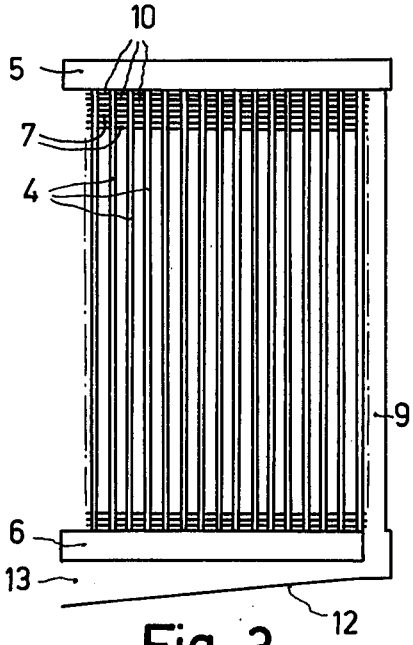
FIG. 3 is a sectional view of another embodiment of a radiator.

It is shown diagrammatically in FIG. 3 that the channels 9 are open on their lower sides and communicate with an outlet channel 12 which is open on the radiator front side of the area 13. When the vehicle is stationary, any contaminations which have remained behind in the channels 9 will fall down and can disappear through the outlet channel 12. Also when the radiator is cleaned by spraying with water, said exhaust channel 12 may be useful. Since the exhaust channel 12 opens at the area 13 on the front of the radiator, the pressure in the channels 9 will not experience any drawback from the open condition of the channels 9 on their lower side.

Figure 4:
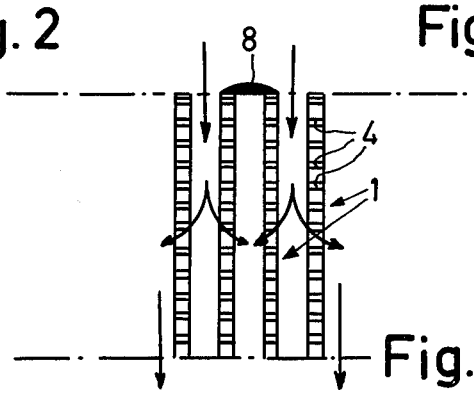
FIG. 4 shows a parallel arrangement of the elements.

FIG. 4 shows how the elements 1 may be arranged in parallel, if desirable, so that, as it were, a crenel-shaped radiator is obtained.

What is claimed is:

1. A radiator operable with a flow of air for cooling a quantity of water, comprising a plurality of pipes positioned generally in parallel forming a substantially flat wall member having thickness L in the range of 1 – 25 mm. and connection elements connecting the pipes in heat transfer relationship, with transverse ducts defined through said wall between said connection elements, the ducts having length L and hydraulic diameter $d_h$, with a ratio $L/d_h < 15$, said radiator comprising at least two of said wall members, each having top and bottom parts and side edges, said two wall members each defining a plane therein and forming in top plan view a V-shape when positioned with respect to a vertical front reference plane, for air flow into the open side of the V toward the closed part, each wall positioned to define an angle $\alpha$ of at least 45° with said reference plane, said angles $\alpha$ being two angles of the triangle formed by said V-shape and reference plane, junction means joining adjacent edges of said wall members along their vertical length and thereby providing a substantially airtight seal, the radiator further comprising inlet and outlet means respectively for receiving into and discharging water from said pipes, said two joined wall members comprising a pair, said radiator being formed of at least two of said pairs forming in top plan view a zig-zag design with adjacent front edges of the two V's joined together along their vertical length in a substantially air-tight seal.

2. Apparatus according to claim 1 wherein said junction of front edges has a curved aerodynamic shape to receive air flow thereagainst.

3. A radiator as claimed in claim 1, characterized in that each of the connections on the rear side of the elements is constructed as a channel-shaped connection member for receiving contaminations.

4. A radiator as claimed in claim 3, characterized in that the channel-shaped connection members communicate on their lower side with an exhaust channel which extends below the radiator and whose aperture faces the front side of the radiator 5. A radiator as claimed in claim 1, characterized in that each of the elements comprises on its outer circumference a layer a fine gauze having a mesh-width smaller than 1.5 mm.

6. A radiator comprising at least one pair of substantially flat wall members having adjacent edges joined, forming a V-shape at the top and bottom ends thereof, junction means joining said adjacent edges, the closed part of the V being the rear of the radiator and the open part of the V being the front thereof, each wall member comprising a plurality of generally parallel pipes, a plurality of connection elements connecting said pipes in heat-transfer relationship and defining between these elements air ducts transverse of the plane of said wall member, the duct length being defined by the wall thickness having dimension L which is a maximum of 25 mm., the ducts also having a hydraulic diameter $d_h$, where $L/d_h$ is less than 15, the radiator further comprising means for receiving water into and for discharging water from said pipes, said radiator comprising at least first and second of said V-shaped structures oriented similarly, with one wall member of one structure adjacent one wall member of the other structure, with adjacent front edges, second junction means joining said adjacent front edges along the length thereof, whereby the radiator defines in top and bottom views a zig-zag design.

7. Apparatus according to claim 6 wherein said second junction means has a curved aerodynamic shape to receive air flow thereagainst.

8. A heat exchanger operable with a flow of a gas for cooling a quantity of a fluid, comprising a plurality of pipes positioned generally in parallel forming a substantially flat wall member having thickness L in the range of 1 – 25 mm. and connection elements connecting the pipes in heat transfer relationship, with transverse ducts defined through said wall between said connection elements, the ducts having length L and hydraulic diameter $d_h$, with a ratio $L/d_h < 15$, said heat exchanger comprising at least two of said wall members, each having top and bottom parts and side edges, said two wall members each defining a plane therein and forming in top plan view a V-shape when positioned with respect to a vertical front reference plane, for gas flow into the open side of the V toward the closed part, each wall positioned to define an angle $\alpha$ of at least 45° with said reference plane, said angles $\alpha$ being two angles of the triangle formed by said V-shape and reference plane, junction means joining adjacent edges of said wall members along their vertical length and thereby providing a substantially gastight seal, the heat exchanger further comprising inlet and outlet means respectively for receiving into the discharging said fluid from said pipes, said two joined wall members comprising a pair, said heat exchanger being formed of at least two of said pairs forming in top plan view a zig-zag design with adjacent front edges of the two V's joined together along their vertical length in a substantially gas-tight seal.

9. A heat exchanger comprising at least one pair of substantially flat wall members having adjacent edges joined, forming a V-shape at the top and bottom ends thereof, junction means joining said adjacent edges, the closed part of the V being the rear of the heat exchanger and the open part of the V being the front thereof, each wall member comprising a plurality of generally parallel pipes, a plurality of connection elements connecting said pipes in heat-transfer relationship and defining between these elements ducts transverse of the plane of said wall member, the duct length being defined by the wall thickness having dimension L which is a maximum of 25 mm., the ducts also having a hydraulic diameter $d_h$, where $L/d_h$ is less than 15, the heat exchanger further comprising means for receiving a fluid into and for discharging said fluid from said pipes, said head exchanger comprising at least first and second of said V-shaped structures oriented similarly, with one wall member of one structure adjacent one wall member of the other structure, with adjacent front edges, second junction means joining said adjacent front edges along the length thereof, whereby the heat exchanger defines in top and botton views a zig-zag design.

* * * * *

UNITED STATES PATENT AND TRADEMARK OFFICE

CERTIFICATE OF CORRECTION

PATENT NO. : 4034804

DATED : July 12, 1977

INVENTOR(S) : ROELF JAN MEIJER; JAN MULDER

It is certified that error appears in the above-identified patent and that said Letters Patent are hereby corrected as shown below:

Col. 1, line 16, "head" should be --heat--

Col. 1, line 28, after "is sufficient" insert --to accommodate a radiator of sufficient--

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*